US006413165B1

(12) United States Patent
Crandall et al.

(10) Patent No.: US 6,413,165 B1
(45) Date of Patent: Jul. 2, 2002

(54) INTERMITTENLY WETTED SLIDING AMUSEMENT RIDE

(76) Inventors: Bill A. Crandall, 114 Smoky Crossing Way, Seymour, TN (US) 37865; Robert O. Groover, 11234 Shelterwood Cir., Dallas, TX (US) 75229

( * ) Notice: Subject to any disclaimer, the term of this patent is extended or adjusted under 35 U.S.C. 154(b) by 8 days.

(21) Appl. No.: 09/191,098

(22) Filed: Nov. 12, 1998

Related U.S. Application Data

(60) Provisional application No. 60/070,917, filed on Nov. 18, 1997.

(51) Int. Cl.[7] ..... A63G 21/10
(52) U.S. Cl. ..... 472/117; 104/70
(58) Field of Search ..... 472/116, 117, 472/128; 104/53, 69, 70, 71

(56) References Cited

U.S. PATENT DOCUMENTS

| | | | | | |
|---|---|---|---|---|---|
| 4,484,739 | A | * | 11/1984 | Kreinbihl et al. | 472/117 |
| 4,805,897 | A | * | 2/1989 | Dubeta | 472/117 |
| 5,230,662 | A | * | 7/1993 | Langford | 472/117 |
| 5,540,622 | A | * | 7/1996 | Gold et al. | 472/117 |
| 5,716,282 | A | * | 2/1998 | Ring et al. | 472/117 |

* cited by examiner

*Primary Examiner*—Kien T. Nguyen

(57) ABSTRACT

A water slide in which the slide surface is not continuously wetted, but is only intermittently wetted (preferably by a water spray). Since the volume of water flowing down the ride is less smaller, riders are not splashed.

13 Claims, 4 Drawing Sheets

INTERMITTENLY WETTED SLIDING AMUSEMENT RIDE

This application claims benefit of Provisional No. 60/070,914 filed Nov. 18, 1997.

BACKGROUND AND SUMMARY OF THE INVENTION

The present application relates to water-based sliding amusement rides.

Background: Amusement Parks and Water Parks

Amusement parks have been a very popular industry for more than a century. Water parks are a recently developed, different type of park, which differ from the general purpose amusement parks in that the rides all involve water and the participants in many of these rides get very wet. Water parks are very popular in the United States, especially in the southern states.

People normally wear swimsuits to water parks, and the attractions typically include various types of swimming pools, as well as water rides.

This necessarily makes water parks a seasonal attraction, even more than would be dictated by school schedules. For example, amusement parks such as Six Flags Over Texas will typically open briefly during school holidays such as Thanksgiving, Christmas, or Spring Break, and very large amusement parks such as Disneyland may never close at all. However, water parks can only be open when the weather is warm enough for swimming. This means that the cooler the climate is, the shorter the season is for a water park. Typically when the air temperature is below 75° F., the admissions to the water park will be much smaller than when the temperature is over 80° F.

Moreover, people in some countries simply do not like getting their clothing massively wet in a public ride in an amusement park. Standards of public modesty vary from country to country, and what is acceptable in the U.S. may not be acceptable in, for example, Japan or other oriental countries.

Background: Enclosed-Slide Rides

In amusement parks, one very popular type of ride is the Racing River Run ride. (The Racing River Run was introduced by New Wave Rides, Inc., but has subsequently been copied by other companies.) In this ride, patrons ride on a raft or sled through a tube which usually has circular cross-section and through which a substantial flow of water is routed. One possible configuration for a ride like this is shown in FIG. 4A, where two tubes 10, each capable of carrying a raft, parallel each other for much of the run, providing several sharp turns. FIG. 4B shows an alternate version, where the tubes 10 are intertwined to give the desired twists and turns. For example, in one prior ride version, the tubing will have a 48-inch diameter circular cross-section, and may go through 40 feet of vertical drop. For a downward angle which gives approximately a 20 second ride, over a distance of 350 feet linear, a typical set-up might use a 15-horsepower pump to provide approximately 900 gallons per minute of water flow through the ride. Riders enter the top of the ride on their raft or sled, and ride downward through the tubing, which is wetted and made slippery by the water. The tubing of the ride is typically fiberglass painted with gel coat paint, so that it is very slippery when wet. A lower flow of water can be used if desired, to provide a slower ride, or for use with a higher degree drop, but the riders will typically get wet in any case. (Because the riders do not actually sit in the water, this ride was publicized as a "dry ride water ride", but nevertheless the riders do get wet, so this is not a dry ride in the same sense as the rides disclosed in the present application.

One of the principal locations where riders get wet in such a ride is at the curves. When the rider comes up to the curve, the bow wave of the raft or sled will ride up the side of the outer edge of the curve, and splash down onto the riders. This bow wave helps to assure that the outer wall of the curve is well wetted, but the inevitable result is that the riders do get soaked. Thus, this ride has always been a ride which is limited to use at reasonably high ambient air temperatures.

One of the main attractions of this ride, as compared to straight water slides, is the curving and the lateral movement. Moreover, the ride may also include transparent sections in the tubing, so that riders find themselves suddenly looking out over a view or even down over a vertical drop, which adds to the excitement. The ride may also contain other interesting features, such as loudspeakers to add sound effects.

In the Racing River Run ride, the ride path curves from side to side. However, the ride must steadily flow downhill, because the water flowing through the tube provides essential lubrication for the riders coming down. Such rides, while very popular, are fairly expensive to build and operate. One of the costs of operation is the water flow. The cost of continually operating a 15-horsepower (or more) pump, whenever the ride is available for use, is relatively high. A 15-horsepower pump will typically consume a little more than 15 kilowatts of electricity.

Dry Curved Water-Slide Ride

The present application discloses a new principle for water ride operation: lubrication is provided not by a flow of water, but by a spray of water on the weight-bearing surface of the slide, which is interrupted before each rider arrives. The inner surface of the ride will hold a water film for long enough for the raft or sled to pass through. This still provides high lubrication and a very fast ride. Additionally, this permits the ride to be operated with a much lower supply of water, and also has many other advantages. A crucial advantage is that the riders do not get wet. Another advantage is that heavy water piping to the top of the tower is not required. Another advantage is that the ride does not have to be constantly downhill, but can now include downhill segments. A further advantage is that, since the riders do not get wet, this ride can be operated at much cooler temperatures. A further advantage is that, since riders do not have to dress in swimsuits, this ride can be used in conventional amusement parks where the users are not expected to wear swimsuits.

Since the water in the slide is no longer necessary, it is preferably drained from the slide interior, so that water pools will not happen at the bottom.

The sprinkling is preferably turned off before the rider arrives. The simplest way to do this is simply to sprinkle the whole length of the tube, and then turn that sprinkling off before the riders arrive. An alternative way is to do this in sections, either using a timing relationship or using electric eye detectors to detect the approach of each raft or sled.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation), in which:

In a sample embodiment, this was demonstrated on a Racing River Run ride with a 48-inch circular cross-section and a 40-foot vertical drop. This ride normally gives a 20-second ride. The linear distance of this ride is approximately 350 feet. Normally this ride is operated with approximately 900 gallons per minute. (Alternatively lower flows could be used to slow down the ride, but in any case normal operation preferably uses at least several hundred gallons per minute.)

Figure 1:
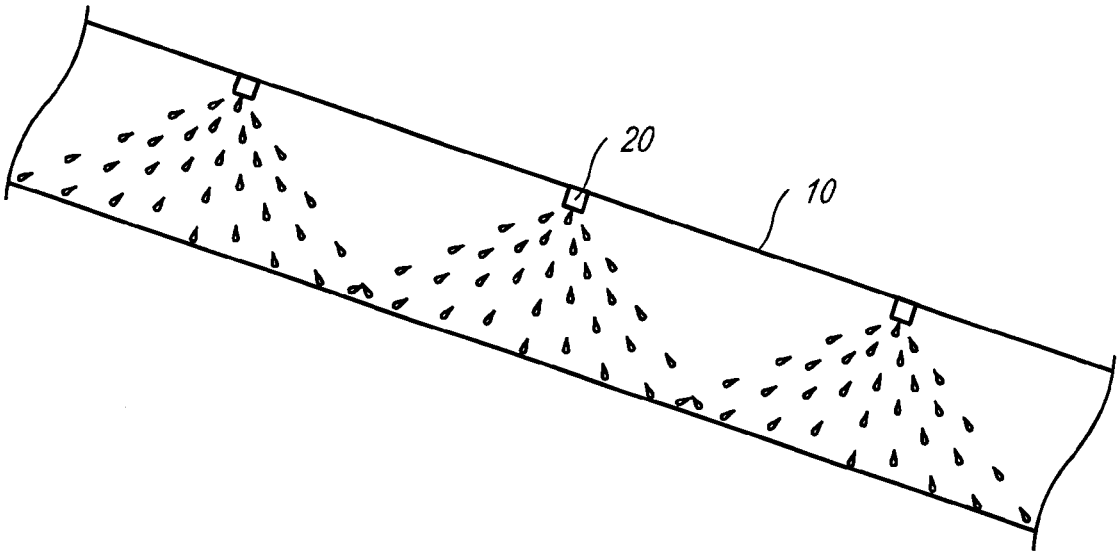
FIG. 1 is a cross-section of the disclosed water ride when no rafts are present.

To demonstrate the present invention, this ride was retrofitted with sprinklers, as is shown in FIG. 1. For simplicity in the drawings, all cross-sections are shown as straight sections, although, of course, they would generally have numerous curves and varying angles of descent. In this sample embodiment, Turow 570 sprinkler heads 20, such as used for lawn sprinkling, were retrofitted into the top surface of the tube 10. (In curved sections, the position of the sprinkler heads was shifted somewhat towards the inside of the tube, so that they would efficiently wet the outside of the tube.) These sprinkler heads were spaced about 15 feet apart over the whole length of the ride. (Spacing was determined by the throw pattern of the sprinklers.)

Sprinklers are preferably positioned to throw a little extra water on the outside of curves, since the film slides off most quickly in these areas.

Water was supplied to these sprinkler heads, at a pressure of about 50 psi at the bottom of the ride. All of these sprinkler heads together consumed a flow of about 17 gallons per minute. (Thus, each head consumes a flow of about one-half to one gallon per minute. The tubing of this ride was fiberglass, internally coated with gel coat paint, as in a conventional Racing River Run ride. This ride was tested with passenger raft loads in the range of 150 to 400 pounds, and the riders emerged completely dry, with not a drop on them.

The spray pattern of each spray head was selected to make sure that the surface of the ride over which the riders would travel was thoroughly wetted by the spray. This was tested with a raft size of six feet by 33 inches, and a flexible inflated raft with a PVC skin. Naturally other raft and sled sizes and tube dimensions can be used, as detailed below.

Figure 2:
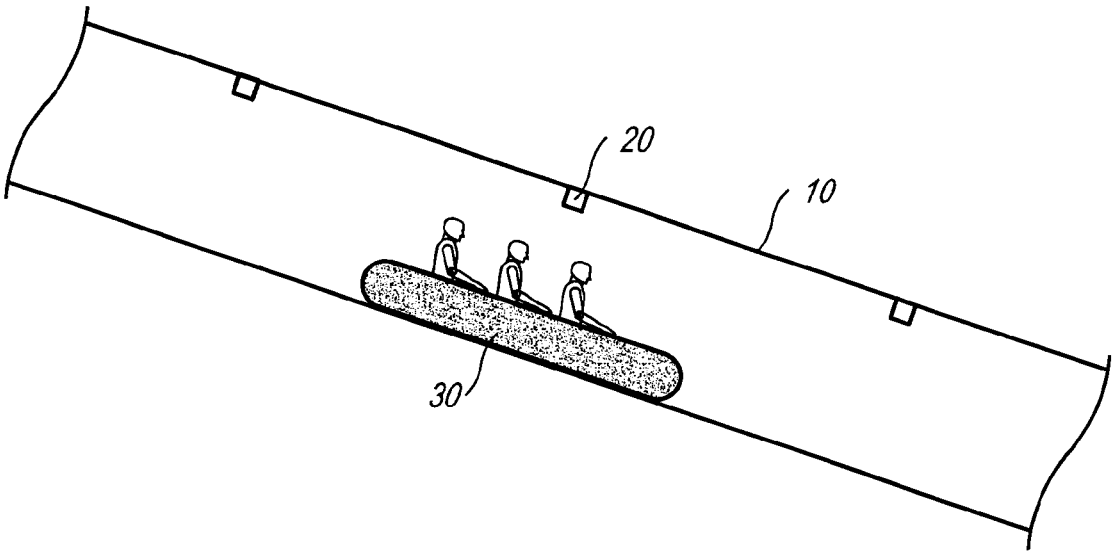
FIG. 2 is a cross-section of the disclosed water ride when rafts are present.

As shown in FIG. 1, the sprinklers 20 are turned on between patrons, providing water spray (dotted lines) to ensure that the weightbearing surfaces are thoroughly wetted. Just before a raft 30 is sent down the ride, sprinklers 20 are turned off, as shown in FIG. 2, allowing the riders to pass through and remain dry.

Design Options

The ride on which this invention was actually tested was a conventional Racing River Run ride. However, the use of the present invention permits variations in ride design. For instance, the ride can have almost any topology that a roller coaster can have. (The only exception is negative G-force sections, since there is no force to pull the raft downwardly.) However, the ride can be designed to have uphill sections and sections where the G-force of the riders is reduced, as long as the downward G-force on the rider, while in a normal vertical attitude, does not become less than zero.

The total flow of water is preferably adjusted to be low enough so that there is no bow wave ahead of the raft, since the presence of the bow wave and curves is what tends to get the riders wet in high-flow designs.

Conventional rides are preferably operated with ambient temperatures of 80 degrees or more. However, the innovative system can operate down to 55 or 50 degrees Fahrenheit. At the lowest operating temperatures, heaters can optionally be provided for user comfort at the ride's entrance and exit.

Note that the innovative ride provided can use all of the tricks with normal Racing River Run ride design, such as transparent windows, or even the use of open-top sections mixed in with other sections. However, the new architecture also permits many other design options to be used.

The humidity on the inside of the ride tubing is preferably fairly high, since the humidity level affects the duration during which a moisture film will cling to the walls.

Alternative Embodiment

Figure 3:
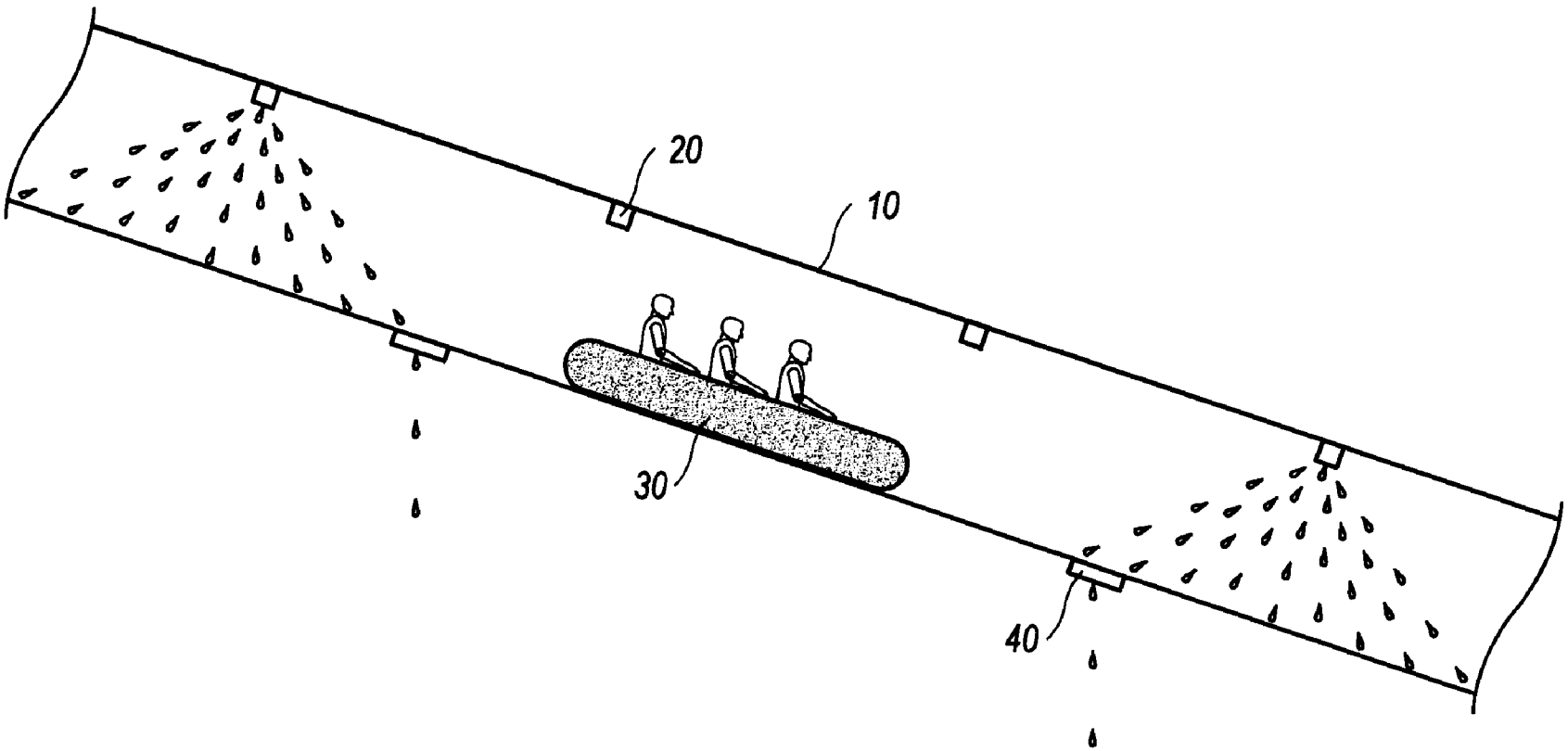
FIG. 3 shows a cross-section of the disclosed water ride, showing an alternate embodiment where the spray mechanism is controlled to turn off only when a raft is present.
Figure 4A:
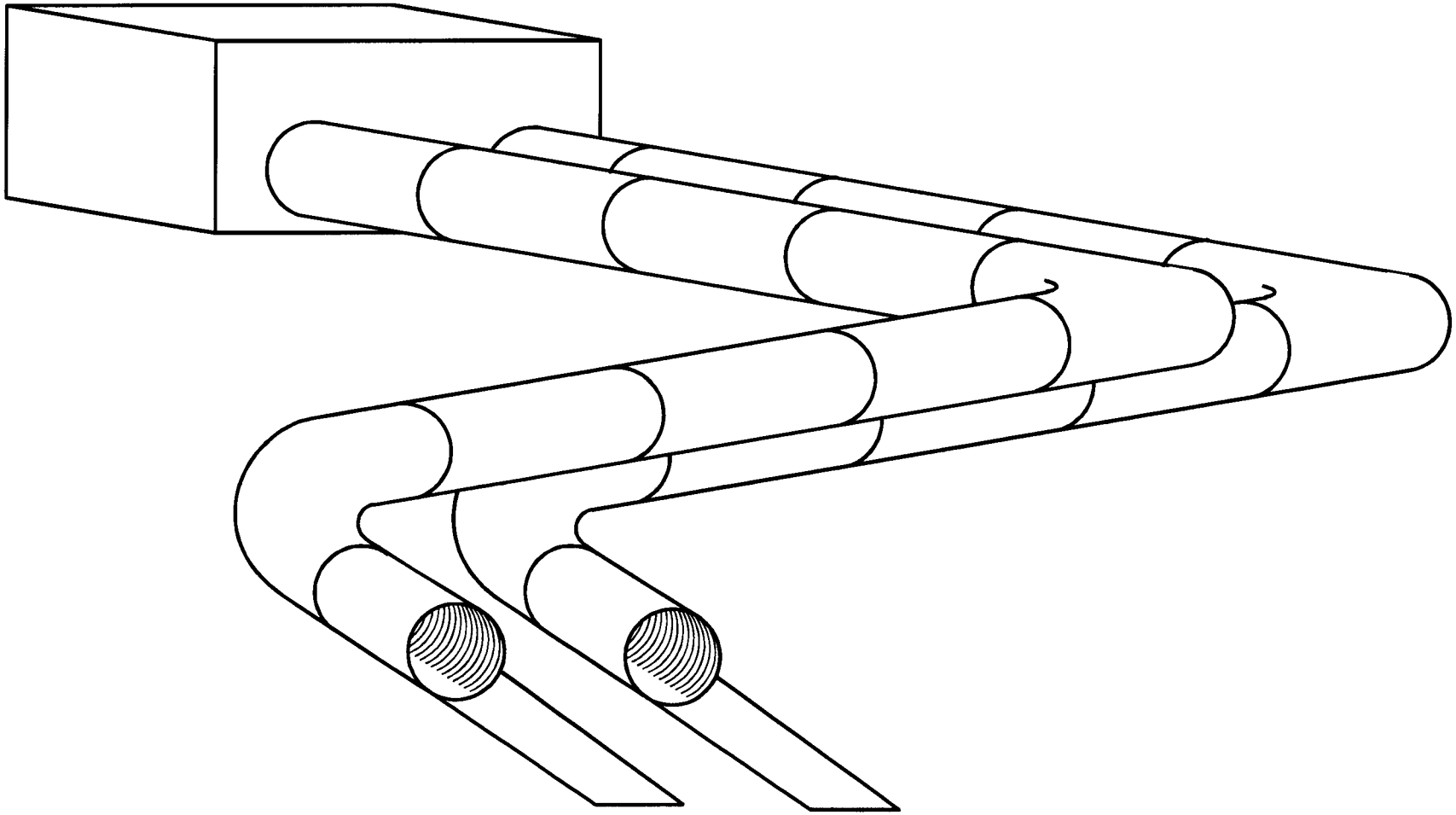
FIGS. 4A and 4B show examples of the exterior of a typical water ride, each having two tubes in different configurations.
Figure 4B:
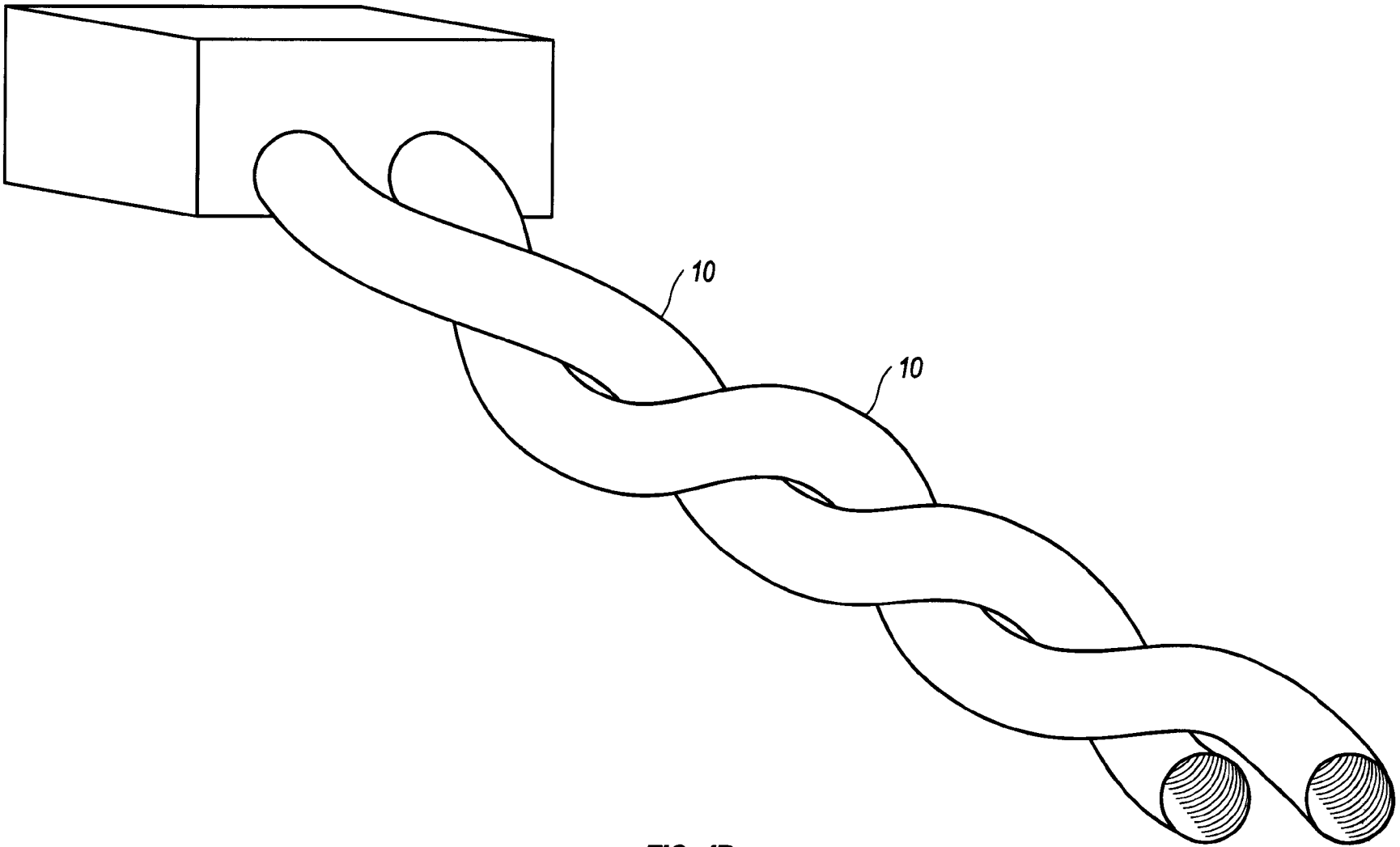

In a further alternative embodiment, shown in FIG. 3, the spray nozzles are controlled individually, rather than as a single unit. For instance, each sprinkler nozzle 20 can be turned off just prior to the arrival of a raft 30, and turned back on after the raft passes. This can add an element of suspense, as passengers would always appear to be about to get wet even though they were never in the spray.

To make the flow of water as controlled as possible, the tube 10 in this alternative class of embodiments includes drains 40 in the ride channel which remove excess water. These can simply be holes in the valleys and low points of the ride tube.

Alternative Embodiment

The boat size with which the ride was actually tested is a normal two to three rider boat. Other boat sizes and shapes are normally used with larger tubing diameters. For instance, rides which use an eight-foot tubing diameter may use a rounded boat which rotates during the run of the ride.

Note that the ride tubing cross-section need not be round. In fact, a cross-section which gives a substantially flat bottom makes it even easier to optimize the ride's acceleration profile. In this class of embodiments the boat does not have to be flexible, but instead can be made of stiffer plastics. There are conventional rides in which the riders ride in a flat boat, and essentially never get wet. However, there are no conventional water-based high-speed rides in which the riders go around curves and never get wet. The presently disclosed ride can use a flat bottom boat or raft, which can be PVC or hypalon (trademark) or can be made from a structural plastic with a spread-on urethane coating.

Optionally, the interior surface of the ride can be modified for better water film retention, although the water film retention of the standard gel-coated fiberglass tubing is already very good.

Design Variations

One of the ride design modifications that are practical with this system is a multi-segment ride, in which conventional rubber belt lifts carry the sleds or rafts from the bottom of one section to the top of another section.

It is noted that a kinetic difference of the present ride from a roller coaster is that the riders themselves may not be strapped in. However, in alternate embodiments, of course rider strapping, even up to the level used in roller coasters, can be added if desired.

It is even possible to have sections, as on roller coasters, where the raft is halted by an uphill section, which then causes the raft to move backward along at least part of its path.

The disclosed ride can also be operated in a second mode of operation, with the spray heads in at least one section on while the riders pass through, so that the riders would be soaked when this is desirable (e.g. in the U.S. in a conventional water park setting during periods of high ambient temperature). Moreover, this feature can be switched on or off for each group of riders, or can be turned off during months that don't have the desired high ambient air temperatures.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. An amusement ride comprising:

a slidable surface arranged in a desired topography;

structural support for said slidable surface;

rider vehicles which are configured to travel down said slidable surface in a purely sliding mode of operation; and spray wetting means positioned to create a water film on said slidable surface before the approach of each rider vehicle;

whereby riders in said rider vehicles remain substantially free from being wetted by splashing.

2. The amusement ride of claim 1, wherein said spray wetting means is connected to turn off before the arrival of each rider vehicle, under at least some circumstances of normal operation.

3. The amusement ride of claim 1, wherein said slidable surface has a fully enclosed cross-section over a majority of its length.

4. The amusement ride of claim 1, wherein multiple portions of said spray wetting means are controlled to individually turn off prior to the arrival of said rider vehicles in a corresponding portion of said slidable surface.

5. The amusement ride of claim 1, wherein, in one mode, a plurality of portions of said spray wetting means are controlled to be turned on while said rider vehicles are in a corresponding portion of said slidable surface.

6. The amusement ride of claim 1, wherein said slidable surface contains drains whereby excess water is removed.

7. The amusement ride of claim 1, wherein said slidable surface contains a plurality of curves.

8. An amusement ride, comprising:

a slidable surface which follows a given path containing changes in direction and an overall vertical drop;

rider vehicles which are configured to travel down said slidable surface in a sliding mode of operation; and wetting mechanisms controlled to wet sections of said slidable surface only when rider vehicles are not present in said sections;

whereby riders in said rider vehicles remain substantially free from being wetted.

9. The amusement ride of claim 8, wherein said wetting mechanisms are connected to turn off before the arrival of each rider vehicle, under at least some circumstances of normal operation.

10. The amusement ride of claim 8, wherein, in one mode, a plurality of portions of said wetting mechanisms are controlled to be turned on while said rider vehicles are in a corresponding portion of said slidable surface.

11. The amusement ride of claim 8, wherein said slidable surface has a fully enclosed cross-section over majority of its length.

12. The amusement ride of claim 8, wherein multiple portions of said wetting mechanisms are controlled to individually turn off prior to the arrival of said rider vehicles in a corresponding portion of said slidable surface.

13. The amusement ride of claim 8, wherein said slidable surface contains drains whereby excess water is removed.

* * * * *